US008274348B2

(12) United States Patent
Kolb et al.

(10) Patent No.: US 8,274,348 B2
(45) Date of Patent: Sep. 25, 2012

(54) SINGLE COIL SOLENOID HAVING A PERMANENT MAGNET WITH BI-DIRECTIONAL ASSIST

(75) Inventors: Richard P. Kolb, Prairie View, IL (US); Kevin G. Nowobilski, Orland Hills, IL (US)

(73) Assignee: Woodward, Inc., Fort Collins, CO (US)

( * ) Notice: Subject to any disclaimer, the term of this patent is extended or adjusted under 35 U.S.C. 154(b) by 641 days.

(21) Appl. No.: 11/780,615

(22) Filed: Jul. 20, 2007

(65) Prior Publication Data

US 2007/0257757 A1 Nov. 8, 2007

Related U.S. Application Data

(62) Division of application No. 10/604,593, filed on Aug. 1, 2003, now Pat. No. 7,280,019.

(51) Int. Cl.
*H01F 7/00* (2006.01)

(52) U.S. Cl. ..... 335/229; 335/234

(58) Field of Classification Search ..... 335/177–179, 335/234, 266, 220–230
See application file for complete search history.

(56) References Cited

U.S. PATENT DOCUMENTS

| | | | | |
|---|---|---|---|---|
| 3,755,766 | A | 8/1973 | Read, Jr. | |
| 4,074,157 | A | 2/1978 | Lace | |
| 4,086,647 | A | 4/1978 | Lace | |
| 4,127,835 | A * | 11/1978 | Knutson | 335/266 |
| 4,168,516 | A | 9/1979 | Lace | |
| 4,407,517 | A | 10/1983 | Neyer | |
| 4,419,643 | A * | 12/1983 | Ojima et al. | 335/234 |
| 4,438,419 | A | 3/1984 | Helinski | |
| 4,442,418 | A | 4/1984 | Myers | |
| 4,470,030 | A | 9/1984 | Myers | |
| 4,623,860 | A | 11/1986 | Baker et al. | |
| 4,679,017 | A | 7/1987 | Mishler et al. | |
| RE32,793 | E | 11/1988 | Baker et al. | |
| 4,845,392 | A | 7/1989 | Mumbower | |
| 4,871,989 | A | 10/1989 | Gross | |
| 4,922,873 | A | 5/1990 | Gaeti | |
| 5,272,458 | A | 12/1993 | Hoffman et al. | |
| 5,592,356 | A | 1/1997 | Ryl et al. | |
| D378,513 | S | 3/1997 | Bandas et al. | |

(Continued)

FOREIGN PATENT DOCUMENTS

| | | |
|---|---|---|
| CH | 395271 | 7/1965 |

(Continued)

OTHER PUBLICATIONS

Solenoids Basics, Synchro-Start Products, Inc., Niles, IL, USA.

*Primary Examiner* — Bernard Rojas
(74) *Attorney, Agent, or Firm* — Ziolkowski Patent Solutions Group, SC

(57) ABSTRACT

A single coil solenoid includes a permanent magnet with bi-directional assist capabilities. The solenoid includes an armature that during de-energization of a single coil of wire is attracted to the permanent magnet thereby maintaining a hold position and during energization of the single coil has a polarity that repels the permanent magnet thereby creating a push/pull force. In this regard, the permanent magnet operates to not only hold the armature but also is used to push the armature when current is induced in the single coil.

20 Claims, 2 Drawing Sheets

U.S. PATENT DOCUMENTS

| | | | | |
|---|---|---|---|---|
| 6,051,897 | A | 4/2000 | Wissler et al. | |
| 6,057,750 | A | 5/2000 | Sheng | |
| 6,199,587 | B1 | 3/2001 | Shlomi et al. | |
| 6,218,921 | B1 | 4/2001 | Eberts et al. | |
| 6,229,421 | B1 | 5/2001 | Floyd et al. | |
| 6,244,298 | B1 * | 6/2001 | Sugita et al. | 137/625.43 |
| 6,265,956 | B1 | 7/2001 | Cascolan et al. | |
| 6,392,516 | B1 | 5/2002 | Ward et al. | |
| 6,459,348 | B1 | 10/2002 | Birkelund | |
| 6,489,870 | B1 | 12/2002 | Ward et al. | |
| 6,498,416 | B1 | 12/2002 | Oishi et al. | |
| 6,501,357 | B2 | 12/2002 | Petro | |
| 6,791,442 | B1 * | 9/2004 | Schmidt | 335/220 |
| 6,816,048 | B2 | 11/2004 | Morita et al. | |
| 7,075,398 | B2 * | 7/2006 | Morita et al. | 335/220 |

FOREIGN PATENT DOCUMENTS

| | | |
|---|---|---|
| GB | 536281 | 12/1938 |
| GB | 2099223 | 4/1982 |
| GB | 2349746 | 8/2000 |
| GB | 2357375 | 6/2001 |
| JP | 59013307 | 1/1984 |
| JP | 59182510 | 10/1984 |
| KR | 2001081459 | 8/2001 |

* cited by examiner

SINGLE COIL SOLENOID HAVING A PERMANENT MAGNET WITH BI-DIRECTIONAL ASSIST

CROSS REFERENCE TO RELATED APPLICATIONS

The present application is a divisional of and claims priority of U.S. Ser. No. 10/604,593 filed on Aug. 1, 2003, the disclosure of which is incorporated herein.

BACKGROUND OF THE INVENTION

The present invention relates generally to electromagnet switching devices and, more particularly, to a single coil solenoid having a permanent magnet with bi-directional assist.

Electromagnet switching devices such as solenoids are commonly used in a number of applications such as shut-off devices for fuel or other types of fluid pumps. Solenoids are frequently used in engine applications in the throttle, choke, valve, clutch, and overspeed protection assemblies. As such, solenoids are typically found in engine driven products such as boats, lawn equipment, automobiles, generators, and the like.

Solenoids are designed to convert electrical energy into mechanical work. Typically, a movable armature or plunger reciprocates linearly from a first to a second position when current is induced in coil(s) in which the armature sits. The current induced in the coil(s) creates a magnetic field about the armature that induces movement in the actuator along one direction. In this regard, the armature may be connected to a device or piece of equipment such that when current is induced in the coil(s), the armature is caused to turn ON, turn OFF, open, or close the device.

Typically, solenoids include either a single coil of copper wire or a pair of coils of copper wire. In a single coil solenoid, when electric current is introduced, a magnetic field forms which causes movement of a plunger or armature. Typically, the magnetic field draws the plunger inward to a retracted or energized position. In a single coil solenoid, the current induced to create the magnetic field to cause movement of the armature or plunger must not only be sufficient to pull or push the plunger but also be sufficient to maintain the plunger in the energized position. A drawback of a single coil solenoid, however, is that when the coil is energized for long periods of time, the coil may overheat thereby rendering the solenoid inoperable. To overcome this drawback, dual coil solenoids are typically used for applications in which the plunger or armature may need to be maintained in an energized position for long periods of time.

A typical dual coil solenoid is shown in FIG. 1. Solenoid 10 includes a first or pull coil 12 and a second or hold coil 14. Generally, the first wound coil operates at a high current level to provide a maximum pull or push on plunger 16. The second wound coil is used to simply hold the plunger in place after the plunger has completed its stroke and requires less energy. The coils 12, 14 are typically fabricated from copper wire and the plunger is magnetic material with a coating or plating to resist wear, friction and corrosion. The amount of current required to maintain the plunger in a hold position is typically less than that needed to push or pull the plunger and, as such, a dual coil solenoid may be energized continuously without overheating. The coils 12, 14 as well as plunger 16 are typically positioned within a steel housing 18 that may include mounting brackets 20 for mounting the solenoid to a frame or other piece of equipment. Some solenoids further include a return spring 22 that is used to bias the plunger 16 in a de-energized position. As such, the magnetic force placed on the plunger through high current in coil 12 must be sufficient to overcome the bias of spring 22. For those solenoids incorporating a return spring 22, a flexible dust boot 24 is commonly used to enclose return spring 22 and is mounted or connected to the housing 18. At an opposite end of housing 18 is typically a double break switch 26 that is controlled to regulate which coil is energized. As such, switch 26 may be actuated such that dynamic control of current inducement in either the pull or push coil 12 or hold coil 14 is maintained. The double break switch 26 is typically sealed against dirt and moisture, and a housing or cover 28 secured to housing 18. Extending through cover 28 is a number of terminals 30 for connecting electrical leads to the solenoid.

As illustrated in FIG. 1, a typical solenoid is constructed with copper wire on a non-conductive, non-magnetic bobbin that creates a coil assembly. The coil assembly is assembled into a magnetically conductive shell that becomes an electromagnet when energized that may create a force on a movable magnetic object such as a plunger or armature. The force exerted on the plunger is directly proportional to the electrical current and the number of turns of wire on the bobbin. That is, the higher the number of ampere-turns, the greater the force imparted. From this proportional relationship, increasing the number of turns or increasing the current may increase the amount of force imparted. Some solenoids, which are particularly used in space constrained applications, utilize two separate coils on the same bobbin. As discussed above, these coils are typically referred to as a "pull" coil and a "hold" coil.

The pull coil, as described above, is designed to carry a very high current generate relatively high forces on the plunger or armature initially. Typically, this high amount of force is for a short period of time at which point the current is switched off to prevent the coil from overheating. The hold coil usually operates with a much lower current and takes advantage of the fact that the plunger requires much less energy to maintain the "pull" force exerted on the plunger or armature. Typically, the pull coils are switched off in different ways but two of the most common ways are either mechanically or electronically. That is, the mechanical switching method usually implements the plunger to interrupt the circuit at or near a zero stroke by opening a set of switch contacts that is a part of the solenoid. The placement of these contacts is critical as is their ability to handle high currents. Switch design has its own unique requirements that must be considered in the overall solenoid design further complicating the solenoid as well as adding cost and potential reliability concerns. On the other hand, electronically controlled solenoids may use relays or solid state switching devices to accommodate switching functionality. These electronic components, however, add costs to the solenoid. Another switching method that uses electronics implements a single coil of wound wire which is similar to a pull coil in that it uses high current to create a high initial force. The electronics therefore supply full power to the coil initially. When the plunger has reached full stroke, typically after a specified time period, the electronics start switching the current on and off at a relatively high frequency to reduce the effective current. This process is typically referred to as pulse width modulation and makes the single high current pull coil effectively also the low current hold coil. However, electronics not only add to the manufacturing cost of the solenoid but also increase the complexity of the solenoid.

It would therefore be desirable to design a solenoid having a single coil of wire that achieves both push/pull and hold functions without the additional cost and complexity of mechanical or electronic switch assemblies.

BRIEF DESCRIPTION OF THE INVENTION

The present invention is directed to a single coil solenoid having a permanent magnet with bi-directional assist overcoming the aforementioned drawbacks.

The solenoid includes a single coil of wound copper wire and a plunger or armature disposed in a bore therein. The plunger is designed to move linearly within the bore of the solenoid when current is induced in the single coil. In a de-energized condition, the plunger is positioned against a spacer comprised of non-magnetic material that is positioned between the plunger and a permanent magnet. When the single coil is not energized, the plunger is attracted to the permanent magnet thereby creating an attractive force between the plunger and the permanent magnet to hold the plunger against the non-magnetic spacer. When the current is induced in the single coil, an electromagnetic condition is created that causes the plunger to have a magnetic polarity that matches the polarity of the permanent magnet. As a result, a repelling force is created or generated between the plunger and the permanent magnet causing the plunger to linearly move away from the spacer. The solenoid further includes an end plate having an attracting stud that when current is induced in the single coil, the polarity of the plunger is attracted to the attracting stud. That is, the attracting stud has a polarity opposite that of the energized plunger. Optionally, the solenoid may include a return spring that biases the plunger against the spacer during de-energization of the single coil. In this regard, the amount of current induced in the single coil must be sufficient to not only reverse the polarity of the plunger, but must also be sufficient to create a force upon the plunger that overcomes the bias of the return spring.

Therefore, in accordance with one aspect of the present invention, a solenoid has a magnetically conductive shell having a single coil of wound wire. The solenoid also has a movable magnetic object disposed within a bore of the single coil, the object configured to receive a magnetic force when current is induced in the single coil. The solenoid also includes a permanent magnet having a fixed polarity that repels the moveable magnetic object when current is induced in the single coil and attracts an end of the movable magnetic object when no current is induced in the single coil.

According to another aspect of the present invention, an electromagnetic switching apparatus includes a bobbin having a single coil of wire wrapped therearound. A movable armature is disposed within the single coil as is a permanent magnet. The permanent magnet is separated from the actuator by a non-magnetic spacer such that the permanent magnet attracts the actuator when the single coil is de-energized and repels the actuator when the single coil is energized.

In accordance with yet another aspect of the present invention, a method of manufacturing a single coil solenoid with permanent magnet bi-directional assist includes the steps of wrapping a single electro-conductive wire around a bobbin and securing a plunger within a bore of the bobbin. The manufacturing process further includes the step of disposing a spacer and a permanent magnet at one end of the plunger and biasing the plunger in a first position against the spacer. An end plate having an attracting stud at an end of the bobbin opposite to that of the permanent magnet is also put in place.

In accordance with a further aspect of the present invention, a single coil solenoid includes a first magnetic circuit between a plunger and a permanent magnet spaced from the plunger at a first electromagnetic condition created when a single coil wire is not energized as well as a second magnetic circuit between a plunger and an attracting member at a second electromagnetic condition created when the single coil of wire is energized.

In accordance with a further aspect of the present invention, a solenoid kit includes a bobbin configured to receive a single coil of wire wrapped therearound as well as a permanent magnet having a fixed polarity. The kit also includes an armature configured to move linearly through a bore of the bobbin as well as a non-magnetic spacer to be disposed between the permanent magnet and the armature.

Various other features, objects and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

Figure 1:
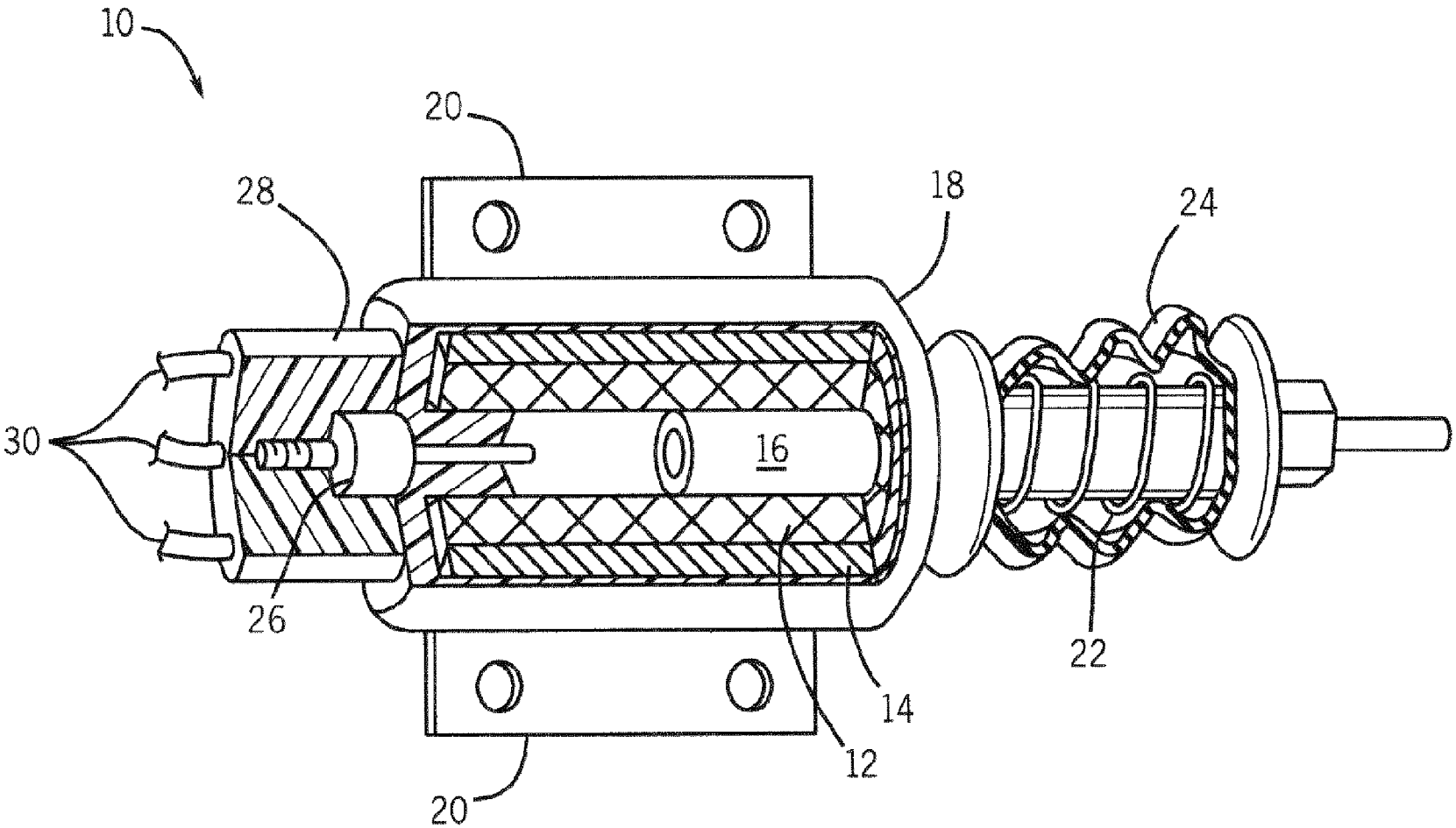
FIG. 1 (PRIOR ART)
FIG. 1 is a cross-sectional view of a prior art solenoid.
Figure 2:
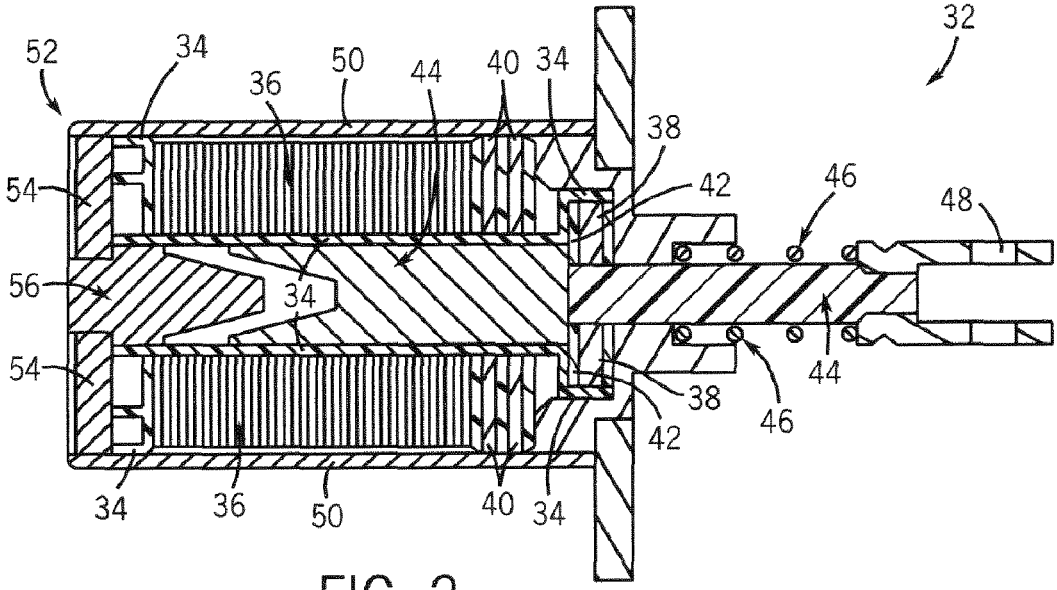
FIG. 2 is a cross-sectional view of a solenoid in a de-energized position.

Referring now to FIG. 2, a single coil solenoid having a permanent magnet with bi-directional assist is shown. The solenoid 32 includes a bobbin 34 designed to have a single coil of wire 36 wrapped therearound. Bobbin 34 is also configured to hold a permanent magnet 38 in a fixed position at one end of solenoid 32. Integrated with the bobbin is a plurality of shunt components 40 which will be described in greater detail below. Preferably, the bobbin 34 also includes a non-magnetic spacer 42 positioned adjacent to the permanent magnet 38 and, as will be described in greater detail below, creates a fixed space or distance between an armature 44 and the permanent magnet 38 when the solenoid is in a de-energized position.

FIG. 2 illustrates solenoid 32 in a de-energized position. In this position, a movable magnetic object such as an armature 44 or plunger is separated from permanent magnet 38 by the non-magnetic spacer 42. When in a de-energized position, i.e., zero or very little current induced in coil 36, armature 44 has no polarity and is therefore attracted to and takes on the characteristics of the permanent magnet 38. In this regard, the attractive force created between the armature and the permanent magnet is such to hold the armature 44 against the non-magnetic spacer 42. One skilled in the art will appreciate that the thickness of spacer 42 may be varied to achieve a desired holding force such that the amount of energy or force required to release the armature upon energization may be regulated for a particular application. A return spring 46 may optionally be used and connected to armature 44 to further bias the actuator against spacer 42. In this regard, the force imposed on the armature 44 is additive between the spring and the magnet. This allows for a higher force to be available out of the solenoid in the at-rest or de-energized position. When the coil is energized, however, the armature 44 is magnetically polarized via shunt components similar to the magnet 38. As a result, the repulsive force between the magnet 38 and the armature 44 adds to the attracting force between the attracting stud 56 and the armature 44 and must be sufficient to overcome the bias of return spring 46.

The internal components of solenoid 32 are housed within a relatively rigid and durable housing 50. Connected at an end 52 of the housing opposite that of the permanent magnet 38 is an end plate 54. Connected to end plate 54 is an attracting stud 56. When current is not induced in the single coil 36, the attracting stud 56 and the armature 44 have no real magnetic polarity. That is, the attracting stud 56 and the end of the armature proximate of the attracting stud have no attractive force between them. In this regard, the attracting force of the magnet and the spring force is generated therebetween such that the armature is pushed away from attracting stud 56. Accordingly, the permanent magnet 38, the armature 44, shunt components 40, and solenoid housing 50 create a complete and efficient magnetic circuit that has a relatively high attractive force on the plunger caused by the permanent magnet 38. The influence of magnet 38 on armature 44 adds to the force of return spring 46 which ensures a relatively high return force to the de-energized position against spacer 42.

Solenoid 32 includes shunt components 40 which assist in creating a relatively high holding force on the armature during de-energization of the single coil 36. Absent these components, the magnetic path would be less efficient and, as such, much of the magnetic flux would be forced to travel through the armature 44 and "jump" a relatively large air gap between the armature and attracting stud 56. In addition, the length of the magnetic path would be much greater thereby requiring more coercive force from permanent magnet 38. The result would therefore be a much lower operating point of the permanent magnet 38 thus reducing the holding force of the armature against the permanent magnet. The effectiveness of shunt components 40 may be varied by changing the air gap between the shunt components 40 and housing 50. This gap not only influences the hold force placed on the armature when de-energized, but also affects the amount of energy required to release the armature when current is induced in the single coil 36. Additionally, the axial location of shunt components 40 relative to magnet 38 also influences the hold force placed on the armature 44 and the amount of energy required to release the armature from a hold position upon energization of the single coil 36. That is, as the distance of the shunt components 40 from the permanent magnet 38 increases, the hold force between the armature 44 and the permanent magnet 38 decreases. Accordingly, placement of the shunt components relative to the permanent magnet, the solenoid housing, and the armature increases the efficiency of the magnetic circuit thereby resulting in an increased hold force in the de-energized position and a reduced energy requirement to release the armature upon energization of the single coil.

As stated above, when zero or little current is induced in the single coil of wire wrapped around the bobbin, the solenoid is considered to be in a de-energized state or position. In this position, the polarity of the armature takes on the polarity of the permanent magnet. The permanent magnet creates an attractive force between the armature and itself. The force of the magnet coupled with the bias of the return spring create the relatively large holding force on the armature 44 that, as illustrated in FIG. 2, maintains a seating of the armature against the device or equipment in which the armature is engaged. As such, current in the single coil is not needed to maintain the armature in an at-rest state or position.

Figure 3:
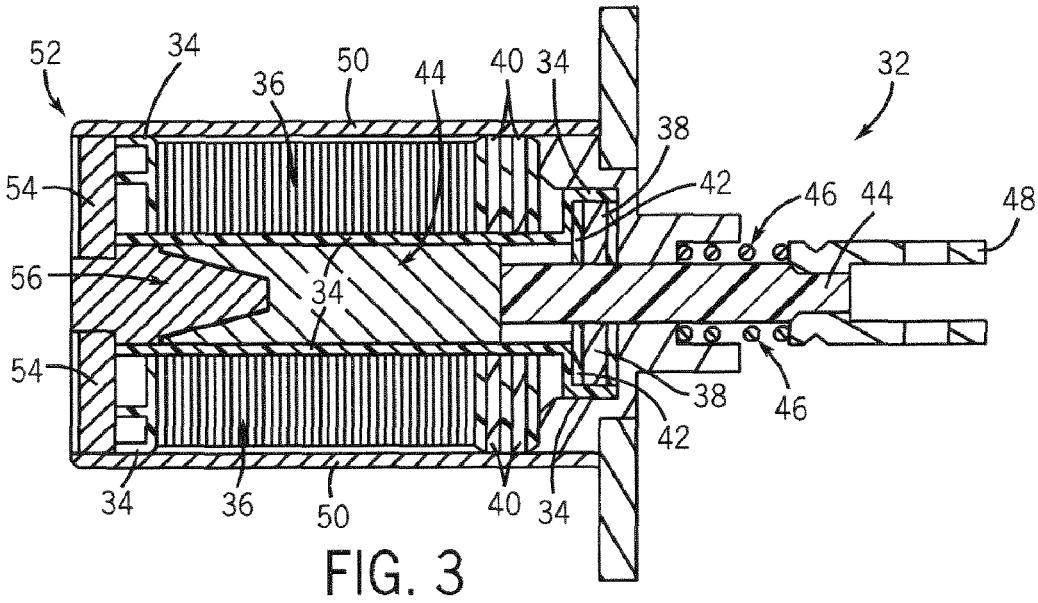
FIG. 3 is a cross-sectional view of that shown in FIG. 2 in an energized position.

Referring now to FIG. 3, solenoid 32 is shown in an energized position. In this regard, current is induced in coil 36. The polarity of the coil must be such that the shunt components 40 have the same polarity as the permanent magnet face that is in close proximity or in contact with the armature. The inducement of current through coil 36 causes the polarity of armature 44 with respect to the magnet to be the same. As such, a repellent force is created between the armature 44 and permanent magnet 38. Further, upon current inducement in coil 36, the polarity of the armature at the poles proximate to the attracting stud 56 is also reversed thereby creating an attractive force between attracting stud 56 and armature 44. When the current induced in single coil 36 is of sufficient amplitude, the attractive force created between attracting stud 56 and armature 44 coupled with the repellent force created between armature 44 and permanent magnet 38 will be sufficient to overcome the bias of spring 46 thereby causing a linear movement of armature 44 in the bore of bobbin 34 toward end plate 54. As such, the return spring 46 is compressed and engaged such that armature 44 is pulled from the device or equipment in which it was engaged during the non-energization of the coil.

A second magnetic circuit is created by housing 50, end plate 54, attracting stud 56, plunger 44, and shunt components 40 when current is induced in the single coil 36. The electromagnetic condition causes the armature 44 to become a magnet with poles opposing the poles of permanent magnet 38 thereby creating a repulsive force therebetween. This repulsive force in combination with the attractive force created between attracting stud 56 and armature 44, minus the mechanical or biasing force of spring 46, produces or creates a higher net pulling force on armature 44 than is possible from the electromagnetic coil alone. Upon de-energization of the coil, return spring 46 returns armature 44 until the armature abuts spacer 42. Since there is no longer an electromagnetic field, as the armature 44 approaches magnet 38, the magnet 38 attracts the armature 44 thereby adding to the force of return spring 46 exerted on the armature 44. Thus, the energy stored in the permanent magnet is utilized to increase the operating force of the armature 44 in both directions of armature stroke.

In an alternate embodiment, a second permanent magnet may be placed with proper orientation between the attracting stud 56 and end plate 54. Placement of a second permanent magnet assists in the magnetic tuning to achieve the desired net forces that are exerted on armature 44. That is, the second permanent magnet may be oriented such that it enhances the force placed on armature 44 by attracting stud 56. Additionally, secondary shunt components may be placed within the coil windings to assist in magnetic tuning to also achieve the desired net forces exerted on armature 44.

Therefore, in accordance with one embodiment of the present invention, a solenoid has a magnetically conductive shell having a single coil of wound wire. The solenoid also has a movable magnetic object disposed within a bore of the single coil, the object configured to receive a magnetic force when current is induced in the single coil. The solenoid also includes a permanent magnet having a fixed polarity that repels the moveable magnetic object when current is induced in the single coil and attracts the end of the movable magnetic object when no current is induced in the single coil.

According to another embodiment of the present invention, an electromagnetic switching apparatus includes a bobbin having a single coil of wire wrapped therearound. A movable armature is disposed within the single coil as is a permanent magnet. The permanent magnet is separated from the armature by a non-magnetic spacer such that the permanent magnet attracts the armature when the single coil is de-energized and repels the armature when the single coil is energized.

In accordance with yet another embodiment of the present invention, a method of manufacturing a single coil solenoid with permanent magnet bi-directional assist includes the steps of wrapping a single electro-conductive wire around a bobbin and securing a plunger within a bore of the bobbin.

The manufacturing process further includes the step of disposing a spacer and a permanent magnet at one end of the plunger and biasing the plunger in a first position against the spacer. An end plate having an attracting stud at an end of the bobbin opposite to that of the permanent magnet is also put in place.

In accordance with a further embodiment of the present invention, a single coil solenoid includes a first magnetic circuit between a plunger and a permanent magnet spaced from the plunger at a first electromagnetic condition created when a single coil winding is not energized as well as a second magnetic circuit between a plunger and an attracting member at a second electromagnetic condition created when the single coil winding is energized.

In accordance with a further embodiment of the present invention, a solenoid kit includes a bobbin configured to receive a single coil of wire wrapped therearound as well as a permanent magnet having a fixed polarity. The kit also includes an armature configured to move linearly through a bore of the bobbin as well as a non-magnetic spacer to be disposed between the permanent magnet and the armature.

The present invention has been described in terms of the preferred embodiment, and it is recognized that equivalents, alternatives, and modifications, aside from those expressly stated, are possible and within the scope of the appending claims.

What is claimed is:

1. An electromagnetic switch comprising:

a conductive coil defining an opening therethrough;

a movable armature positioned at least partially within the opening and moveable between maximum fore and aft positions;

an attracting member positioned at a first end of the coil;

a first permanent magnet positioned at a second, opposite end of the coil; and wherein the armature, attracting member, and first permanent magnet are arranged along a common axis with respect to one another such that, when the conductive coil is de-energized the armature is caused to move to the maximum fore position by the magnet, and when the conductive coil is energized, a repulsive force is generated between the first permanent magnet and the armature which is additive to an attractive force generated between the attracting member and the armature to move the armature to the maximum aft position away from the magnet.

2. The electromagnetic switch of claim 1 further comprising a second permanent magnet positioned adjacent to the first end of the armature and configured to attract the armature towards the attracting member.

3. The electromagnetic switch of claim 1 further comprising a shaft extending from the second end of the armature and a return spring disposed about the shaft, the return spring arranged to bias the armature away from the attracting member.

4. The electromagnetic switch of claim 1 further comprising a first shunt positioned at the second end of the coil, the shunt configured to magnetically polarize the armature when the coil is energized.

5. The electromagnetic switch of claim 4 further comprising a secondary shunt positioned within the coil.

6. A single-coil solenoid comprising:

a housing;

an electro-conductive coil wound about a bobbin;

a movable armature at least partially disposed in a bore of the bobbin;

a permanent magnet configured to attract the movable armature in a first direction to a bias position by the permanent magnet, when the coil is de-energized;

an attracting stud configured to attract the movable armature in a second direction, when the electro-conductive coil is energized; and a shunt positioned to have an air gap between the shunt and the housing and an axial position relative to the permanent magnet, the air gap and the axial position having dimensions selected to optimize an efficiency of a magnetic circuit formed between the permanent magnet, the housing, and the armature.

7. The single-coil solenoid of claim 6 further comprising a return spring configured to impose a biasing force on the armature in the first direction.

8. The single-coil solenoid of claim 6 wherein the shunt is configured to magnetically polarize the armature when the coil is energized, to create a repulsive force between the permanent magnet and the armature.

9. The single-coil solenoid of claim 8 wherein the repulsive force is additive with an attractive force between the attracting stud and the armature.

10. The single-coil solenoid of claim 6 further comprising a second permanent magnet positioned to attract the armature in the second direction and a second shunt positioned among windings of the coil.

11. The single-coil solenoid of claim 6 wherein the shunt is positioned such that the air gap and the axial position of the shunt at least partially define an increased hold force placed on the armature when the coil is de-energized.

12. The single-coil solenoid of claim 11 wherein the shunt is positioned such that the air gap and the axial position of the shunt at least partially define a decreased energy required to release the armature from a hold position upon energization of the coil.

13. A method of manufacturing a single coil solenoid with permanent magnet bi-directional assist comprising the steps of;

wrapping a single electro-conductive wire around a bobbin;

securing a plunger within a bore of the bobbin;

disposing a spacer and a permanent magnet at one end of the plunger;

biasing the plunger in a first position against the spacer;

placing an end plate having an attracting stud at an end of the bobbin opposite to that of the permanent magnet; and arranging the plunger, attracting stud and permanent magnet along a common axis with respect to one another such that, when the electro-conductive wire is de-energized the plunger is caused to move the maximum force position by the magnet, and when the electro-conductive wire is energized, a repulsive force is generated between the permanent magnet and the plunger which is additive to an attractive force generated between the attracting stud and the plunger to move the plunger to the maximum aft position away from the magnet.

14. The method of claim 13 further comprising the step of securing a return spring to be operationally connected to the plunger such that the return spring biases the plunger against the spacer when current is not induced in the wire.

15. The method of claim 13 further comprising the step of configuring the plunger to have a polarity similar to that of the permanent magnet when current is not induced in the wire and to have a polarity opposing that of the permanent magnet when current is induced in the wire.

16. The method of claim 13 further comprising the step of placing a set of shunt components radially around the plunger between the permanent magnet and the wire.

17. The method of claim 13 further comprising arranging the permanent magnet and a return spring to impose a force on the plunger, wherein the force imposed is additive between the spring and the permanent magnet.

18. The method of claim 13 further comprising disposing at least one shunt component adjacent to the electro-conductive wire to magnetically polarize the plunger when the electro-conductive wire is energized.

19. The method of claim 18 wherein a repulsive force is generated between the magnet and the plunger and an attractive force is generated between the plunger and the attracting stud, when the at least one shunt magnetically polarizes the plunger.

20. The method of claim 13 further comprising providing a housing for the single coil solenoid and determining at least one of an axial location of the at least one shunt component relative to the magnet and an air gap between the at least one shunt component and the housing in order to optimize a hold force on the armature when the wire is de-energized and an energy requirement to release the armature when the wire becomes energized.

* * * * *